US007445479B2

(12) United States Patent
Fan et al.

(10) Patent No.: US 7,445,479 B2
(45) Date of Patent: Nov. 4, 2008

(54) ELECTRONIC CONNECTING DEVICE

(75) Inventors: Chien-Ming Fan, Guangdong (CN); Wei-Kuo Sung, Guangdong (CN); Jung-Hsiang Lee, Guangdong (CN); Chang-Lin Yang, Guangdong (CN)

(73) Assignee: Hon Hai Precision Industry Co., Ltd,, Tu-Cheng, Taipei Hsien (TW)

( * ) Notice: Subject to any disclaimer, the term of this patent is extended or adjusted under 35 U.S.C. 154(b) by 68 days.

(21) Appl. No.: 11/309,469

(22) Filed: Aug. 10, 2006

(65) Prior Publication Data

US 2007/0254509 A1 Nov. 1, 2007

(30) Foreign Application Priority Data

Apr. 28, 2006 (CN) ..... 2006 1 0060510

(51) Int. Cl.
*H01R 29/00* (2006.01)

(52) U.S. Cl. ..... 439/171; 439/247; 439/131; 439/151; 439/863; 439/770

(58) Field of Classification Search ..... 439/151–152, 439/836–837, 770–772, 863, 131, 247, 640, 439/171
See application file for complete search history.

(56) References Cited

U.S. PATENT DOCUMENTS

| | | | | |
|---|---|---|---|---|
| 6,036,510 | A * | 3/2000 | Ono et al. | 439/157 |
| 6,061,233 | A | 5/2000 | Jung | |
| 6,142,593 | A | 11/2000 | Kim et al. | |
| 6,264,484 | B1 * | 7/2001 | Chien et al. | 439/152 |
| 6,542,358 | B1 * | 4/2003 | Kunz et al. | 361/686 |
| 6,813,145 | B2 * | 11/2004 | DeLuga | 361/679 |
| 6,952,343 | B2 * | 10/2005 | Sato | 361/686 |
| 7,131,852 | B1 * | 11/2006 | Chen | 439/131 |
| 2002/0186531 | A1 | 12/2002 | Pokharna et al. | |

* cited by examiner

*Primary Examiner*—Truc T Nguyen
(74) *Attorney, Agent, or Firm*—Winston Hsu

(57) ABSTRACT

An electronic connecting device includes a plate defining an opening therein, a connector for being movable along the opening, a controller for shifting the connector to different height positions.

17 Claims, 7 Drawing Sheets

ELECTRONIC CONNECTING DEVICE

FIELD OF THE INVENTION

The present invention relates to electronic connecting devices and, more particularly, to an electronic connecting device with a high compatibility.

DESCRIPTION OF RELATED ART

Portable computers, such as notebook computers and personal digital assistants (PDAs), are popular and commonly used devices that provide users with mobile computing power in small, lightweight, portable packages. The portable computer usually offers less functionalities than what a desktop computer brings because the portable computer may lack certain peripheral devices (e.g. a CD-ROM drive or a floppy drive).

A docking station has been developed to enhance and extend functions found in a desktop computer to a portable computer. The docking station typically provides a connector connecting a connector of the portable computer, thereby establishing an electronic connection between the portable computer and the docking station.

However, connectors' heights of docking stations and connectors' heights of portable computers are not always compatible. Various docking stations accommodate connectors with different heights. Heights are so different that docking stations generally must pair up with a specific type of portable computers. Compatibilities of different type docking stations are greatly decreased.

Therefore, an electronic connecting device with a high compatibility is desired.

SUMMARY OF THE INVENTION

An electronic connecting device includes a plate defining an opening therein, a connector for being movable along the opening, a controller for shifting the connector to different height positions.

Other advantages and novel features will become more apparent from the following detailed description of preferred embodiments when taken in conjunction with the accompanying drawings, in which:

DETAILED DESCRIPTION OF THE INVENTION

In the following embodiments, a docking station for a portable computer is used as an example for illustration. It is noted that electronic apparatuses in these embodiments may be portable computers, cell phones, power chargers, or any other portable electronic apparatuses.

Figure 1:
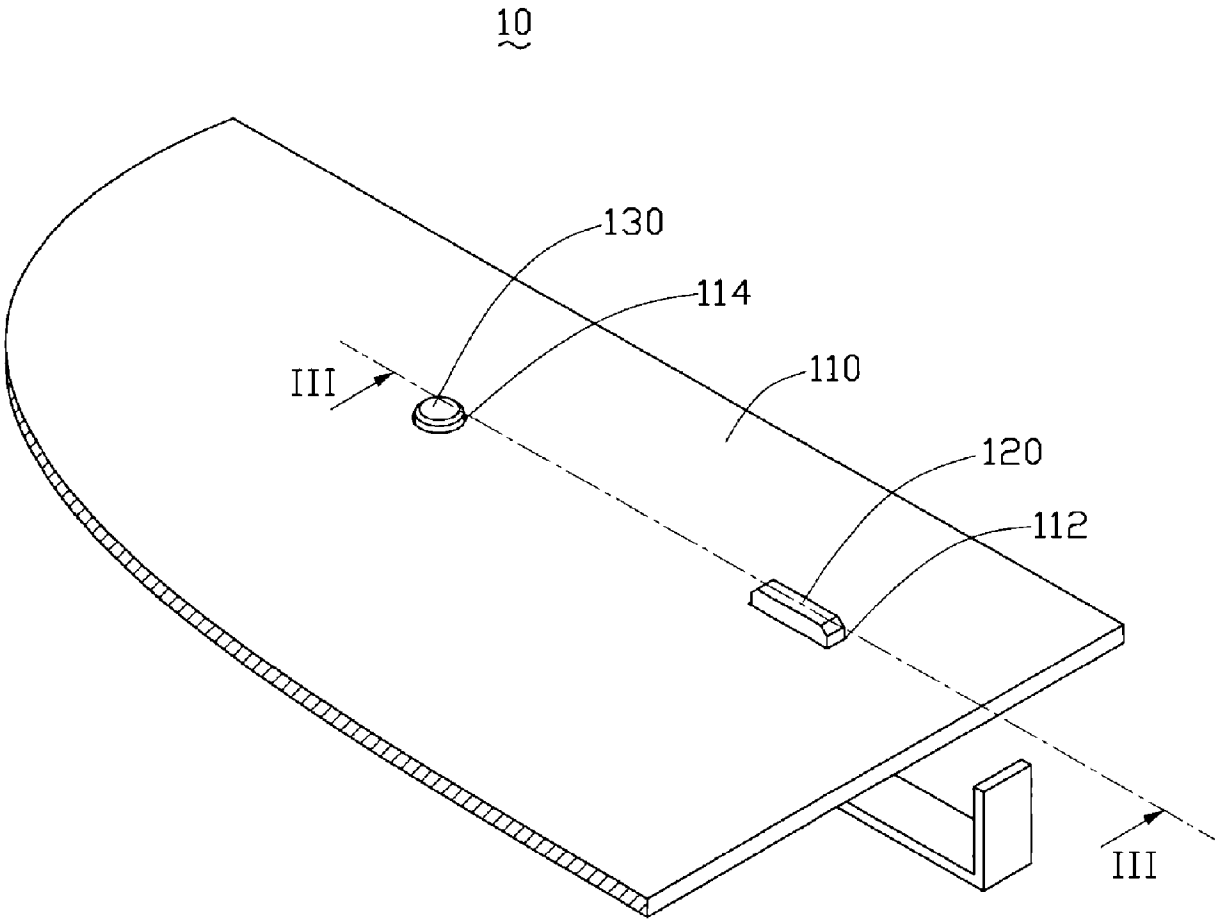
FIG. 1 is an isometric view of an electronic connecting device for an electronic apparatus in accordance with an exemplary embodiment.
Figure 2:
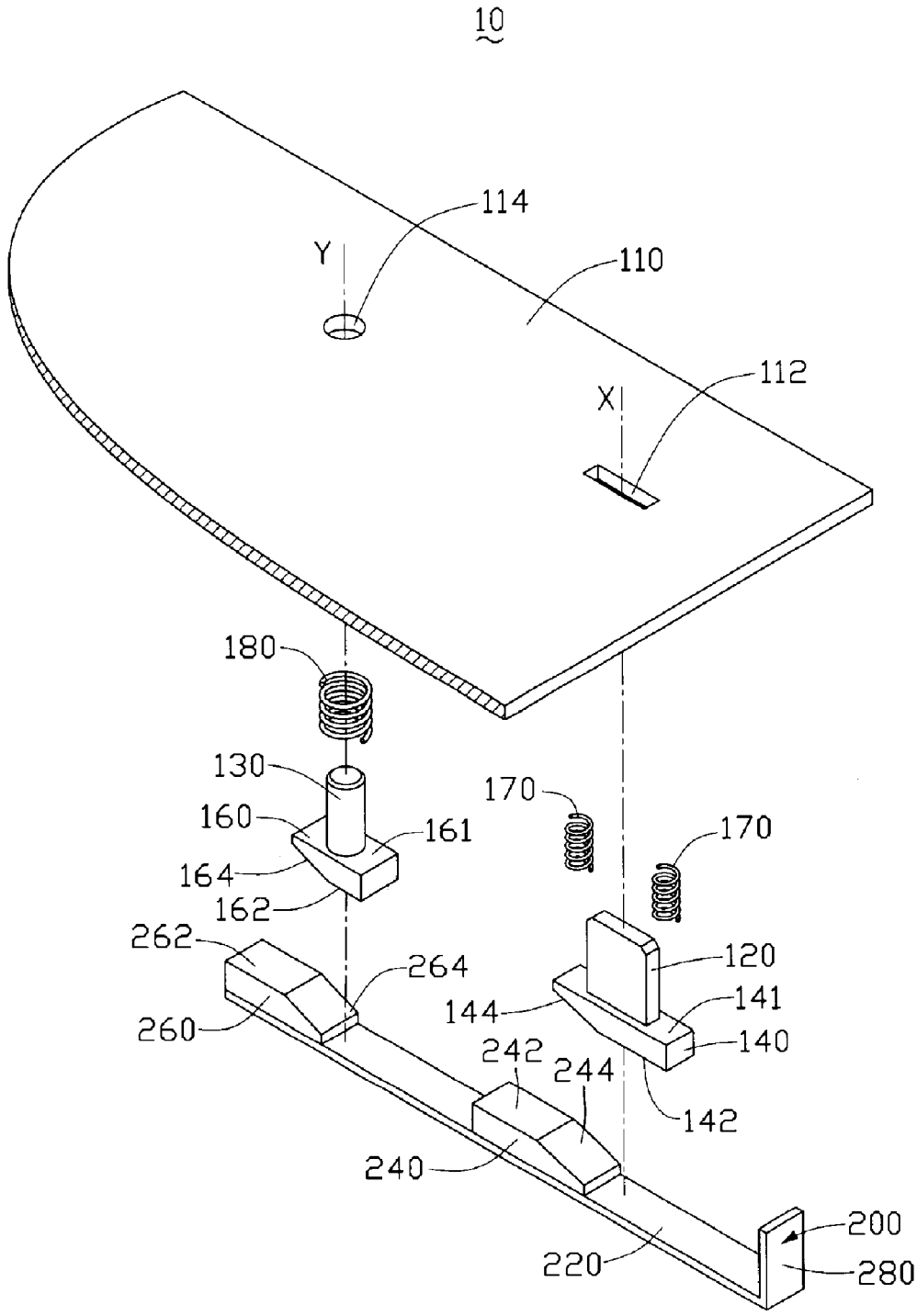
FIG. 2 is an exploded, isometric view of the electronic connecting device of FIG. 1.

Referring to FIGS. 1 and 2, an electronic connecting device 10 according to a first embodiment is illustrated. The electronic connecting device 10 includes a plate 110, a connector 120, a positioning pin 130, a first supporting portion 140, a second supporting portion 160, two first springs 170, a second spring 180, and a controller 200.

Figure 3:
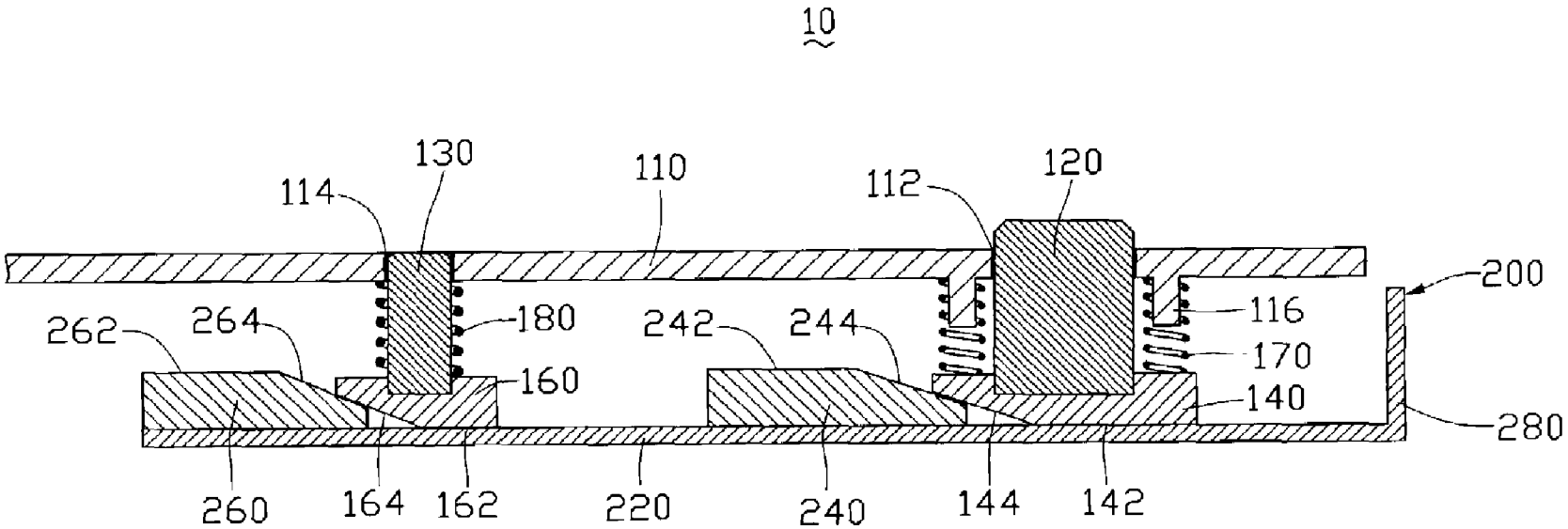
FIG. 3 is a cross-sectional view of the electronic connecting device of FIG. 1 taken along line III-III thereof, with a connector being in a first height position.

An opening 112 and a positioning hole 114 are defined in the plate 110. Referring also to FIG. 3, two posts 116 protrude from a bottom side of the plate 110 and respectively arranged at two opposite sides of the opening 112 for the two first springs 170 to be assembled thereon. The connector 120 passes through the opening 112 and is capable of ascending or descending along an axial direction X. The positioning pin 130, which is surrounded by the second spring 180, is inserted in the positioning hole 114 and is capable of ascending or descending along an axial direction Y.

The first supporting portion 140 is approximately wedge-shaped, and includes a first top surface 141 for the connector 120 to be fixed thereon, a first bottom surface 142, and a first inclined surface 144 adjoined to the first bottom surface 142. Two first springs 170 are located on the first top surface 141. The second supporting portion 160 is approximately similar to the first supporting portion 140 and includes a second top surface 161 for the positioning pin 130 to be fixed thereon, a second bottom surface 162, and a second inclined surface 164 connected to the second bottom surface 162. The second top surface 161 supports the second spring 180 engaging around the positioning pin 130.

The controller 200 includes a slat portion 220, a first lifting portion 240 corresponding to the first supporting portion 140, a second lifting portion 260 corresponding to the second supporting portion 160, and a handle 280 perpendicularly extending for a distal end of the slat portion 220. The first lifting portion 240 and the second lifting portion 260 are aligned on the slat portion 220. The first lifting portion 240 is approximately wedge-shaped and conforms to the first supporting portion 140. The first lifting portion 240 includes a third top surface 242 parallel to the first bottom surface 142 and a third inclined surface 244 parallel to the first inclined surface 144. The second lifting portion 260 is also wedge-shaped and includes a fourth top surface 262 parallel to the second bottom surface 162 and a fourth inclined surface 264 parallel to the second inclined surface 164.

The first springs 170 are assembled on the posts 116 correspondingly and restricted between the plate 110 and the first supporting portion 140 for keeping restoring forces that is capable of pushing the connector 120 towards the slat portion 220. The second spring 180 is installed on the positioning pin 130 and confined between the plate 110 and the second supporting portion 160 for keeping restoring forces that is capable of pushing the positioning pin 130 towards the slat portion 220.

A protruding height of the connector 120 relative to the plate 110 is adjustable. Referring to FIG. 3 again, the connector 120 is at a first height position when the first bottom surface 142 of the first supporting portion 140 is in contact with the slat portion 220. Similarly, the positioning pin 130 is also at a lowered height position when the second bottom surface 162 is in contact with the slat portion 220.

Figure 4:
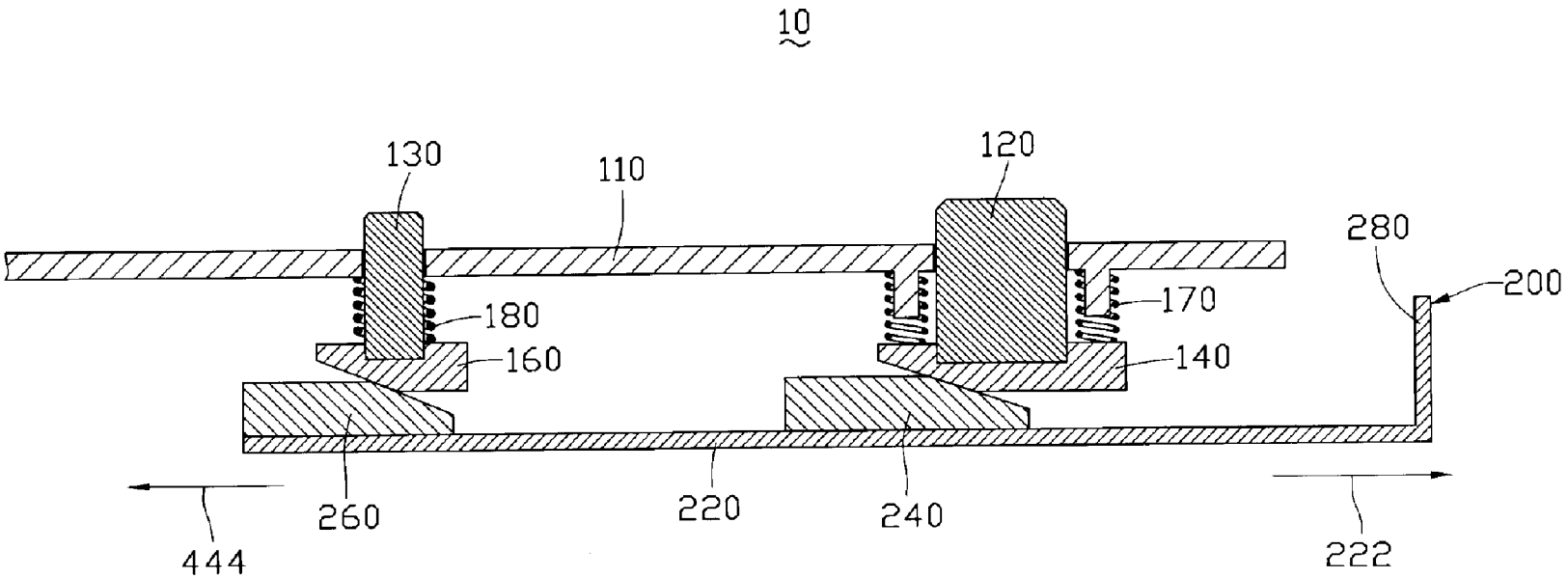
FIG. 4 is a cross-sectional view of the electronic connecting device of FIG. 1 taken along line III-III thereof, with the connector being in a transitional position.

Referring also to FIG. 4, when the handle 280 is drawn along a first direction 222, the first lifting portion 240 follows the motion of the slat portion 220. The third inclined surface 244 conforms to the first inclined surface 144 so that the first lifting portion 240 can smoothly slide the first supporting portion 140 upwards. The connector 120 rises along with the first supporting portion 140. The first springs 170 are compressed to restore energy so that restoring forces can be kept. A motion of the positioning pin 130 is similar to that of the connector 120. The second spring 180 is also compressed.

Figure 5:
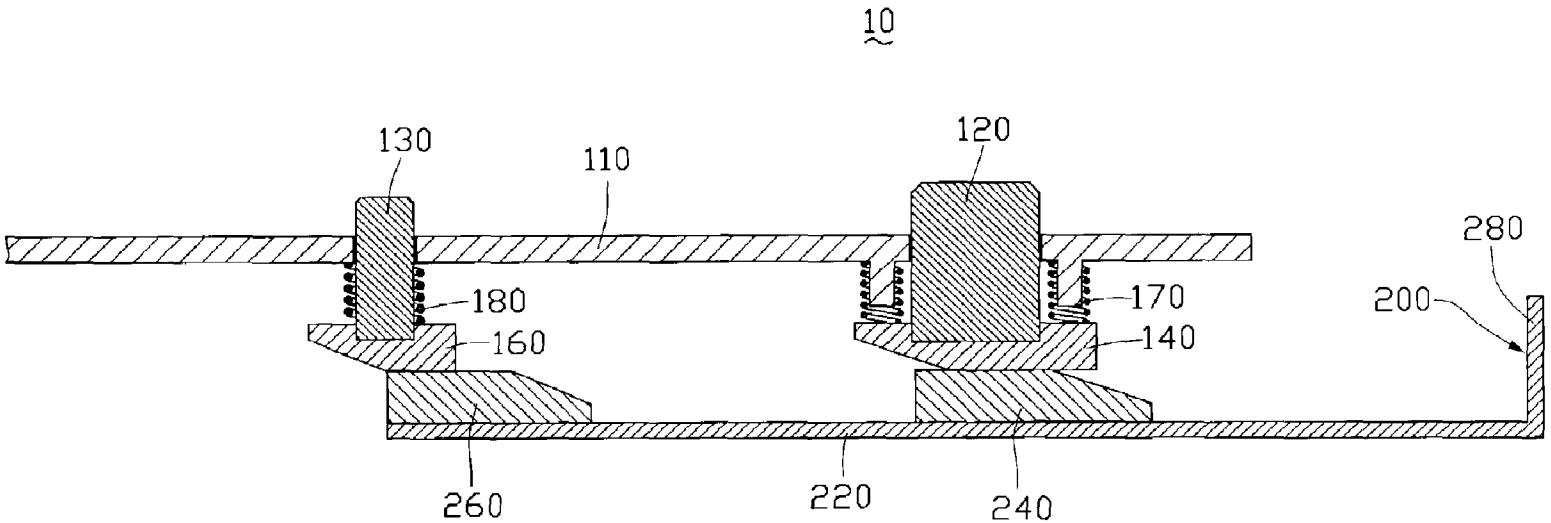
FIG. 5 is a cross-sectional view of the electronic connecting device of FIG. 1 taken along line III-III thereof, with the connector being in a second height position.

Referring also to FIG. 5, the handle 280 is further drawn along the first direction 222, the first bottom surface 142 is supported by the third top surface 242, the connector 120 is at a second height position. Similarly, the second bottom surface 162 is supported by the fourth top surface 262 and thus the positioning pin 130 also arrives at a greater height position.

The handle 280 is pushed along a second direction 444 which is opposite to the first direction 222 when the connector 120 needs to be adjusted from the second height position to the first height position. The positioning pin 130 can also be simultaneously adjusted from the greater height position to a lower height position.

Figure 6:
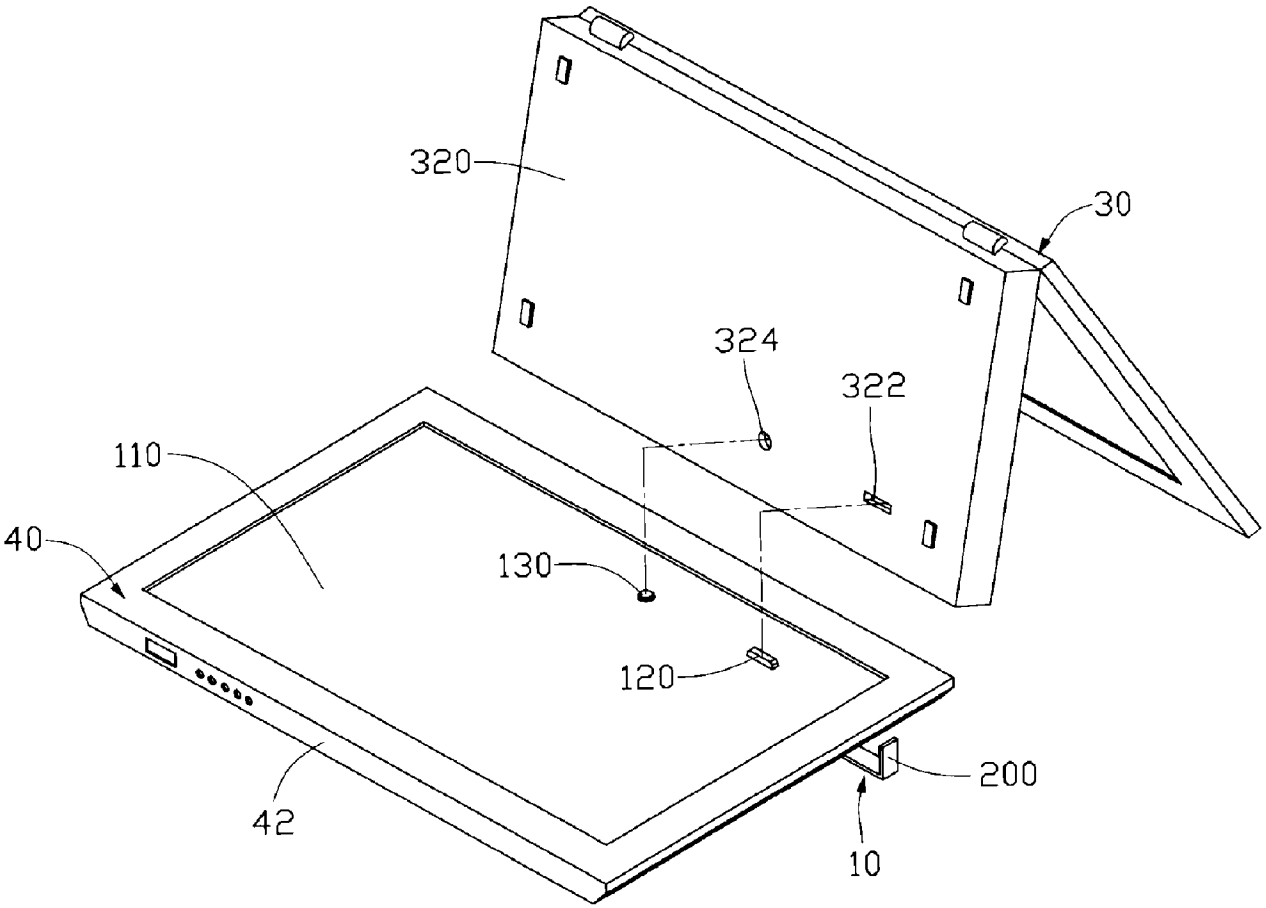
FIG. 6 is an isometric view of a portable computer and a docking station employing the electronic connecting device of FIG. 1.

Referring also to FIG. 6, an assembly of a portable computer 30 and a docking station 40 is illustrated. The portable computer 30 includes a bottom plate 320, a connector 322 fixed on the bottom plate 320. A positioning hole 324 is defined in the bottom plate 320. The docking station 40 includes the previously described electronic connecting device 10 and a housing 42 for accommodating the electronic connecting device 10. The portable computer 30 and the docking station 40 may be electronically interconnected via an engagement of the connector 322 and the connector 120 of the electronic connecting device 10. The positioning pin 130 is inserted in the positioning hole 324 for guiding the engagement of the connector 322 and the connector 120. The protruding height of the connector 120 relative to the plate 110 can be adjusted in order to conform to a certain height of the connector 322 of the portable computer 30. Therefore, a high compatibility between the docking station 40 and different type portable computers can be achieved.

Figure 7:
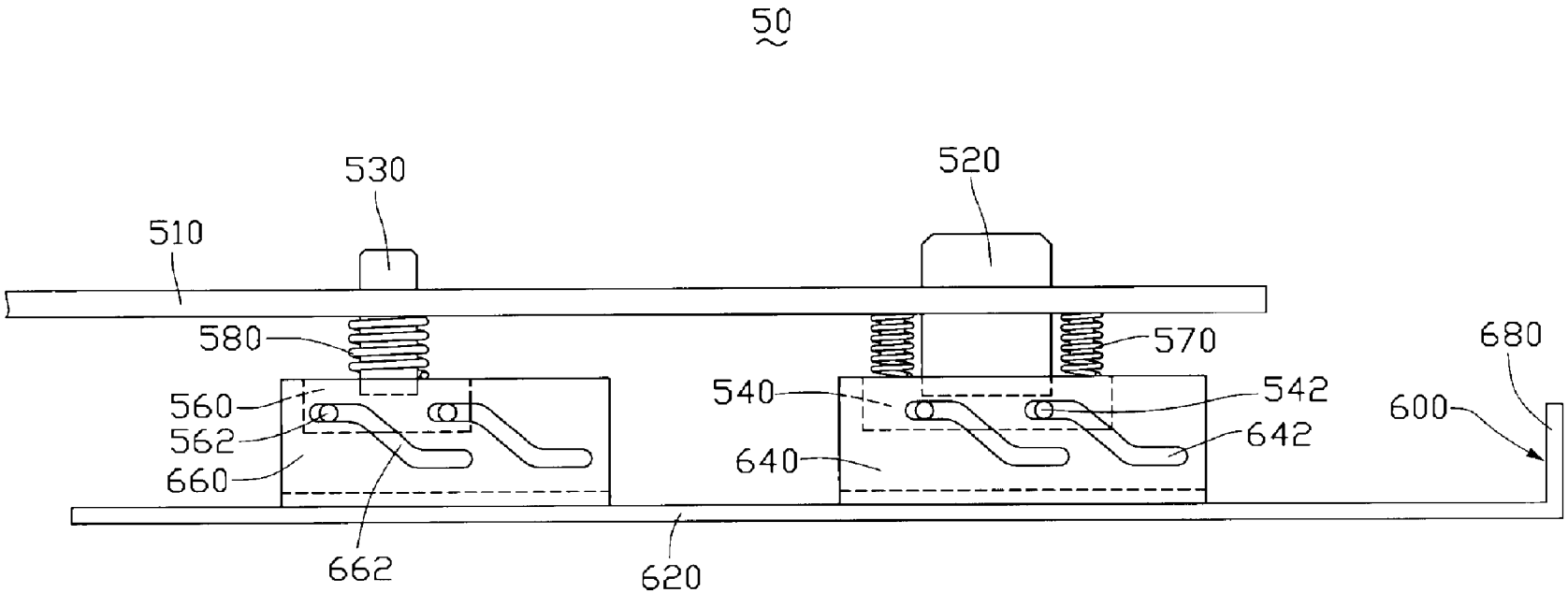
FIG. 7 is an isometric view of a controlling portion of an electronic connecting device in accordance with a second exemplary embodiment.

Referring also to FIG. 7, an electronic connecting device 50 in accordance with a second exemplary embodiment is illustrated. The electronic connecting device 50 includes a plate 510, a connector 520, a positioning pin 530, two supporting portions 540 and 560, three springs 570, 580, and a controller 600. Two protrusions 542 are secured on the supporting portion 540. Two protrusions 562 are secured on the supporting portion 560. The controller 600 includes a slat portion 620, two lifting portions 640 and 660 fixed on the slat portion 620, and a handle 680 connected to a distal end of the slat portion 620. The lifting portion 640 includes a pair of side portions arranged at two opposite sides of the supporting portion 540. A pair of stepped slots 642 are defined in each sidewall (not labeled) for the corresponding protrusion 542 to ride thereon. The lifting portion 660 also includes a pair of side portions arranged at two opposite sides of the supporting portion 560. A pair of approximately stepped slots 662 are defined in each sidewall (not labeled) for the corresponding protrusion 562 to slid therein. When the handle 680 is pulled outward or pushed inward, the protrusions 542 and 562 are movable along the slots 642, 662 respectively. Accordingly, the connector 520 and the positioning pin 530 can be moved up and down to achieve different protruding heights.

The embodiments described herein are merely illustrative of the principles of the present invention. Other arrangements and advantages may be devised by those skilled in the art without departing from the spirit and scope of the present invention. Accordingly, the present invention should be deemed not to be limited to the above detailed description, but rather by the spirit and scope of the claims that follow, and their equivalents.

What is claimed is:

1. An electronic connecting device comprising:

a plate defining at least one opening therein;

at least one electrical connector configured to be movable along an axial direction of the at least one opening;

at least one first supporting portion for maintaining the at least one electrical connector;

at least one first resilient member restricted between the plate and the at least one first supporting portion for maintaining restoring force; and a controller mechanically coupled to the at least one electrical connector for shifting the at least one electrical connector to different positions relative to the plate along the axial direction.

2. The electronic connecting device as claimed in claim 1, wherein the controller includes at least one first lifting portion configured for raising the at least one first supporting portion.

3. The electronic connecting device as claimed in claim 1, further comprising a positioning pin, a second supporting portion, and a second lifting portion for ascending/descending the second supporting portion, a positioning hole being defined in the plate for the positioning pin to insert therein.

4. The electronic connecting device as claimed in claim 2, wherein the controller further includes a sliding portion for carrying the first lifting portion.

5. The electronic connecting device as claimed in claim 2, wherein the at least one first supporting portion includes a first guiding portion, and the lifting portion includes a second guiding portion configured to be engaged with the first guiding portion in a manner so as to cause a relative movement between the second guiding portion and the first guiding portion.

6. The electronic connecting device as claimed in claim 5, wherein the first guiding portion and the second guiding portion are a pair of wedges.

7. The electronic connecting device as claimed in claim 5, wherein the first guiding portion is a plurality of guiding protrusions protruding from each of two opposite sides of the at least one first supporting portion respectively.

8. The electronic connecting device as claimed in claim 7, wherein the lifting portion further includes a pair of sidewalls arranged at the two opposite sides of the at least one first supporting portion, and the second guiding portion comprises a pair of stepped slots that are defined in the pair of sidewalls for the corresponding guiding protrusions to be inserted therethrough and to be movable therealong.

9. The electronic connecting device as claimed in claim 4, wherein the sliding portion includes a slat portion for arranging the at least one first supporting portion, and a handle arranged at a distal end of the slat portion for being pulled outward or pushed inward.

10. The electronic connecting device as claimed in claim 3, wherein a second resilient member engages with the positioning pin and is restricted between the plate and the second supporting portion for maintaining restoring force.

11. An electronic connecting device comprising:

a plate defining at least one opening therein;

at least one electrical connector configured to be movable along an axial direction of the at least one opening;

at least one first supporting portion configured for maintaining the at least one electrical connector;

at least one resilient member restricted between the plate and the at least one first supporting portion for maintaining restoring force; and at least one first lifting portion configured for bringing the at least one first supporting portion together with the at least one electrical connector to move relative to the plate along the axial direction.

12. The electronic connecting device as claimed in claim 11, further comprising a sliding portion configured for carrying the first lifting portion.

13. The electronic connecting device as claimed in claim 11, wherein the at least one first supporting portion includes a first guiding portion, and the lifting portion includes a second guiding portion configured to be engaged with the first guiding portion in a manner so as to cause a relative movement between the second guiding portion and the first guiding portion.

14. The electronic connecting device as claimed in claim 13, wherein the first guiding portion and the second guiding portion are a pair of wedges.

15. The electronic connecting device as claimed in claim 13, wherein the first guiding portion is a plurality of guiding protrusions protruding from each of two opposite sides of the at least one first supporting portion respectively.

16. The electronic connecting device as claimed in claim 15, wherein the lifting portion comprises a pair of sidewalls arranged at the two opposite sides of the at least one first supporting portion, and the second guiding portion comprises a pair of stepped slots that are defined in the pair of sidewalls for the corresponding guiding protrusions to be inserted therethrough and to be movable therealong.

17. An electronic connector comprising:

a plate defining an opening therein having a first axis;

an electrical connector received in the opening;

a supporting portion fixed with the connector, the supporting portion having a first guiding portion;

a controller movable in a second axis perpendicular to the first axis, the controller having a second guiding portion configured to be engaged with the first guiding portion in a manner so as to cause the electrical connector to move relative to the plate along the first axis from a first stage to a second stage when the controller is moved along the second axis; and a resilient member biasing the combination of the electrical connector and the supporting portion in a direction away from the opening in the first stage, and maintaining restoring force between the plate and the controller for engaging the electrical connector in the opening in the second stage.

* * * * *